United States Patent [19]

Balje

[11] 3,963,369

[45] June 15, 1976

[54] DIFFUSER INCLUDING MOVABLE VANES

[75] Inventor: Otto E. Balje, Los Angeles, Calif.

[73] Assignee: Avco Corporation, Williamsport, Pa.

[22] Filed: Dec. 16, 1974

[21] Appl. No.: 532,932

[52] U.S. Cl. ..... 415/148; 415/181

[51] Int. Cl.[2] ..... F04D 29/46

[58] Field of Search ..... 415/211, 207, 181, 163, 415/149, 148, 146

[56] References Cited

UNITED STATES PATENTS

| | | | |
|---|---|---|---|
| 1,136,877 | 4/1915 | Homersham | 415/146 |
| 2,341,974 | 2/1944 | Browne | 415/163 |
| 2,456,779 | 12/1948 | Goetzel | 416/241 |
| 2,967,013 | 1/1961 | Dallenbach et al. | 415/181 |
| 2,976,013 | 3/1961 | Hunter | 415/163 |
| 3,243,159 | 3/1966 | Hefler et al. | 415/163 |
| 3,333,762 | 8/1967 | Vrana | 415/211 |
| 3,799,694 | 3/1974 | Duzan | 415/163 |
| 3,873,232 | 3/1975 | Stein et al. | 415/211 |
| 3,930,746 | 1/1976 | Kronogard | 415/149 |

*Primary Examiner*—Henry F. Raduazo

*Attorney, Agent, or Firm*—Charles M. Hogan; Irwin P. Garfinkle

[57] ABSTRACT

A diffuser for use with a centrifugal compressor utilizes a symmetric arrangement of vanes which direct the gas flow along a plurality of passageways that are substantially tangential to the outer periphery of the impeller. Each vane making up the array is pivotally mounted near its opposite ends. Controls are provided so that rotation of the vane assembly about the innermost set of pivot points will vary the cross-sectional area of the ducts formed between adjacent vane members. This allows efficiency of the diffuser-compressor combination to be maximized for a multiplicity of speed and load conditions.

2 Claims, 6 Drawing Figures

DIFFUSER INCLUDING MOVABLE VANES

BACKGROUND OF THE INVENTION

This invention relates to improvements in the construction of diffusers used with centrifugal compressors. Of particular concern are the diffusers and compressors used in gas turbine engines. In these engines, it is common practice to configure an impeller such that it delivers a compressible fluid, usually air, at high velocities to a diffuser in which the fluid is decelerated to produce a pressure rise.

Conventional vaned diffusers having multiple tangential channels are well known in the prior art. The Moss U.S. Pat. No. 2,157,002 is an example of an early diffuser. Later, as velocities increased to transonic and supersonic levels, attention had to be given to designs which minimized flow pattern disruption due to generation of shock waves. The techniques disclosed in U.S. Pat. Nos. 3,333,762, 3,420,435 and 3,658,437 typify means used for making diffusers intended for high speed applications. A paper which discusses diffuser theory is titled "High Pressure Ratio Centrifugal Compressors for Small Gas Turbine Engines", authored by R. E. Morris and D. P. Kenny and presented in Ottawa at the 31st meeting of the Propulsion and Energetics Panel of AGARD "Helicopter Propulsion Systems", on June 10–14, 1968. Another paper covering diffuser theory is titled "A Novel Low Cost Diffuser for High Performance Centrifugal Compressors". This paper was authored by D. P. Kenny and presented at the Gas Turbine Conference & Products Show held Mar. 17–21, 1968 in Washington, D.C. Later, the paper was published by the ASME as document 68-GT-38.

While the prior art suggests the use of a plurality of intersecting passages, the present invention provides an array of specially shaped, symmetrically spaced, movable vanes that are arranged to tangentially intersect just outboard of the periphery of the rotor of a centrifugal compressor. With forward and rear end plates in place, the area between vanes forms individual throats or pipes along which the compressible fluid from the compressor is ducted. By pivoting the vanes on each end, the throat size of each duct can be made to vary in accordance with speed and load conditions. The fixed vane diffusers do not have this feature and hence operate most efficiently at one specific set of speed and load conditions.

SUMMARY OF THE INVENTION

The preferred diffuser in accordance with this invention makes use of an annular member closely surrounding the impeller. The annular member has a plurality of identical and circumferentially spaced passages which lead tangentially away from a common circle substantially equal in diameter to the periphery of the impeller. The elements which define the tangential boundaries of each of the passageways are all alike, consisting of a vane which is pivotally mounted near its opposite ends. Each vane has a doubly concave cross-sectional shape which, when paired with its like neighbor and in combination with end plates forms a passageway through which the high velocity fluid passes. By making the vanes pivotable near their innermost end and locating the inner pivot points around the arc of a circle, it is possible to change the cross-sectional size of the passageways defined between the walled surfaces while at the same time maintaining the adjacent walls parallel, one with the next. Positional control of the vane assembly is achieved by inserting the outermost pivot points of the vane assembly into a series of equispaced slots formed in a flat circular ring which is rotatably mounted on the outer periphery of the diffuser. It has been found that rotation of the control ring by a few degrees changes the size of the passageway formed between adjacent vane members by an amount adequate to maintain good operating efficiency over a wide range of speed and load conditions.

The leading edge of each vane member is specially configured to accommodate transonic pressure waves. An elliptical leading edge is used which has a highly swept configuration. The shape is such that it compensates for the nonuniform velocity profile of the fluid entering the diffuser.

The outer discharge ends of the vaned assembly is of substantially cylindrical formation around the impeller axis. Fluid entering at high velocity from the impeller slows as the volume expands. As it slows, the pressure rises and fluid of substantially constant high pressure is available over the full circumference of the diffuser.

BRIEF DESCRIPTION OF THE DRAWINGS

The following figures illustrate a preferred embodiment of the invention.

DESCRIPTION OF PREFERRED EMBODIMENT

Figure 1:
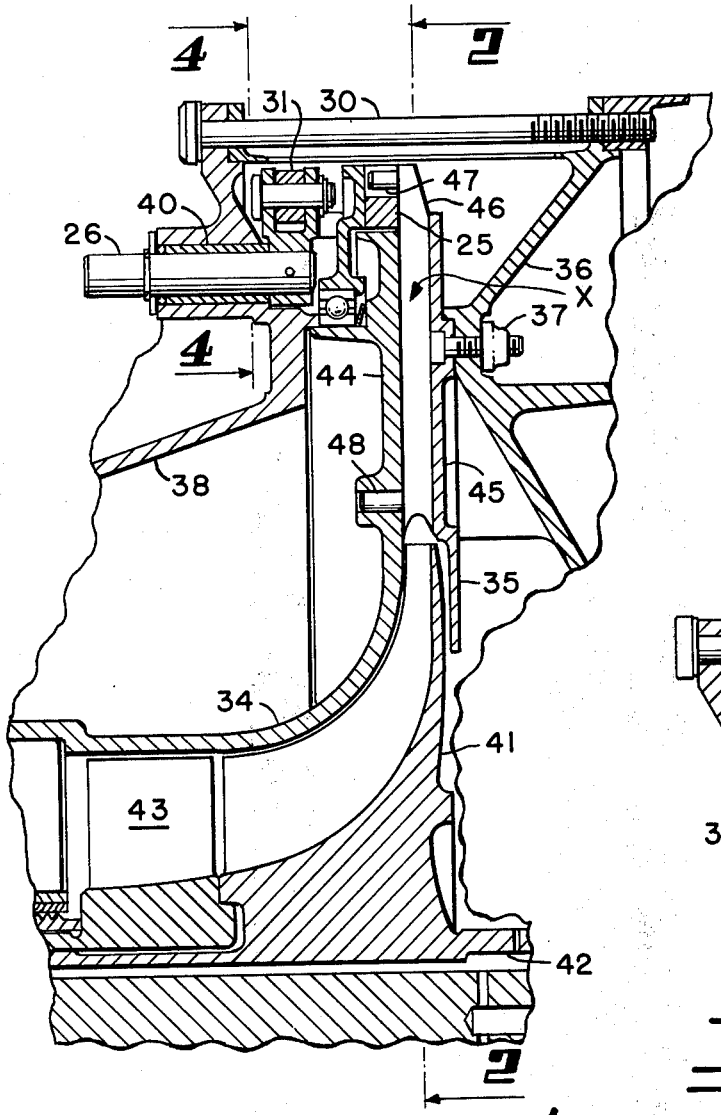
FIG. 1 is a partly sectional view of the impeller and diffuser showing the axial relationship of the two assemblies and the means whereby high velocity fluids from the compressor enter the passageways of the diffuser.

In FIG. 1 there is shown a centrifugal impeller rotor 41 on a shaft 42. The impeller may form part of the compressor of an aircraft gas turbine engine and in FIG. 1 it is shown as succeeding the final stage of an axial compressor with blade 43 being the inducer section for the rotor.

Circumferentially surrounding rotor 41 is the compressor exterior housing member 34. Housing member 34 extends radially beyond the impeller assembly and forms the front end plate 44 of a diffuser, generally indicated at X. The rear end plate 45 of the diffuser is conventionally attached by means of fasteners 37 to a frame strut 36 which is a structural member of the engine. End plate 45 is integral with shroud housing 35 at the back of impeller rotor 41. Frame strut 36 is held in place by a plurality of bolts 30 which secure the inner assembly to frame member 38.

Between diffuser end plate members 44 and 45 there is provided a number of fluid flow passages. One of the passage dividers is shown in edge view as vane 46. Vane 46 is pivotally mounted near its opposite ends. These are shown as pivot shafts 47 and 48 in FIG. 1.

Figure 2:
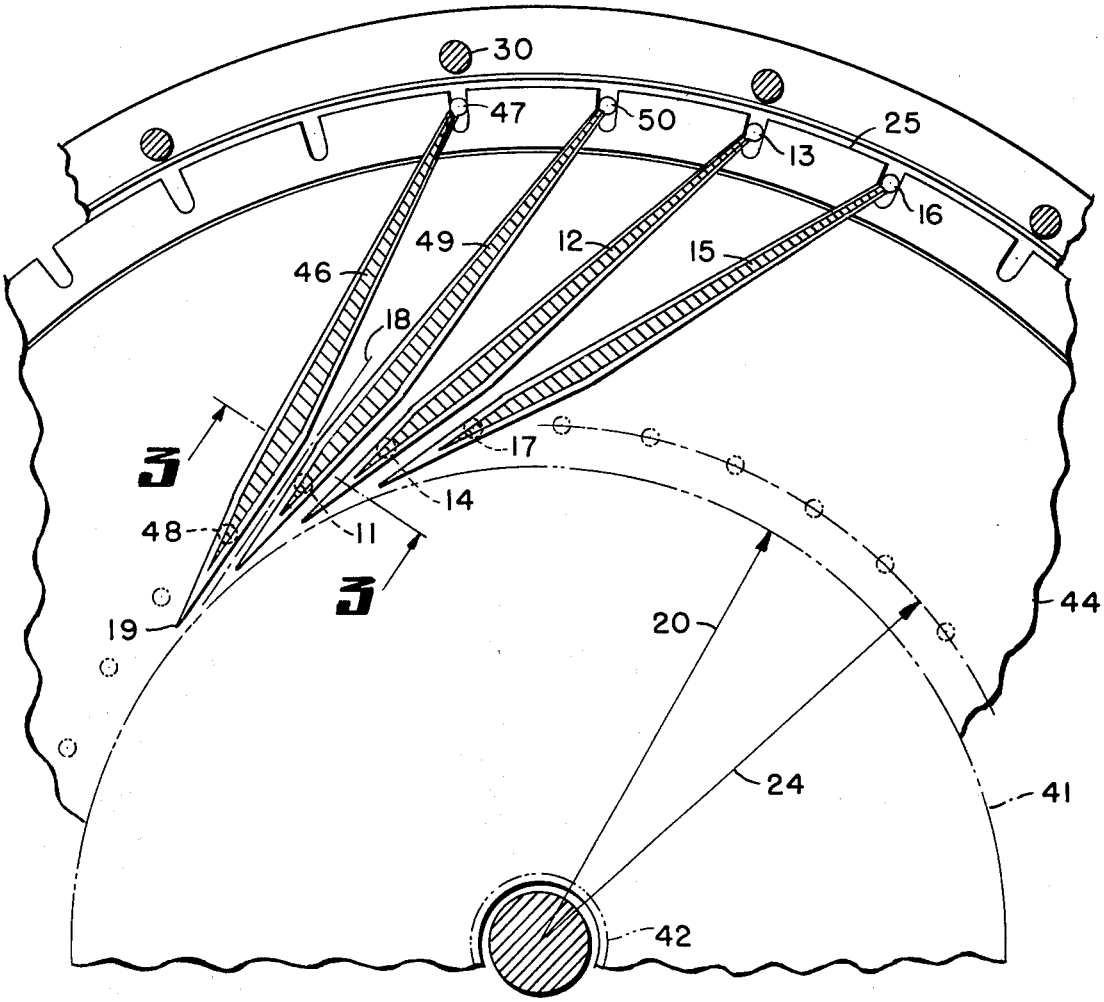
FIG. 2 is an end-on view of the diffuser taken along line 2—2 of FIG. 1.

FIG. 2 shows an end view of the diffuser taken along line 2—2 of FIG. 1. Impeller rotor assembly 41 rotates on shaft 42. In turning, the tips of the impeller blades trace out an arc having radius 20. Accelerated fluid exits the rotor at its periphery and enters the annular throat of the diffuser which closely surrounds the impeller. There the fluid flow is separated in portions of approximately equal volume and caused to traverse passageways formed by a multiplicity of symmetrically spaced vanes. Four such vanes 46, 49, 12 and 15 are shown in FIG. 2. With rotor 41 operating at its design speed, the fluid velocity at the periphery of the impeller blades can become either transonic or supersonic. The shape and arrangement of diffuser vanes 46, 49, 12, 15 et al. must be such that formation of shock waves is minimized under supersonic flow conditions. This is accomplished as follows: First, the centerlines of the passageways between vanes (for example, see the centerline of passageway 18) are tangent to a common circle which has approximately the same diameter as the peripheral arc of the impeller. Second, the cross-section of the vane at the inner part of the diffuser is made to be concave (see FIG. 3, vanes 46 and 49). Third, the leading edge of each vane (see FIG. 6) is made elliptical. This elliptically shaped leading edge produces a highly swept configuration which matches the velocity profile of the fluid entering the diffuser. Thus, by the use of elliptically shaped leading edges for the vanes, there is provided a transition section in the annular member surrounding the periphery of the impeller. The transition section receives the high speed compressible fluid coming from the impeller and delivers it in approximately equal portions to a plurality of channels.

By forming a throat area with round or nearly round cross-sections, the flow is uniformized so that it enters the downstream (diverging) section with a more uniform flow profile. This is important to avoid separation (and therefore high losses) in the diverging section. Conventional diffusers with rectangular cross-sections have a high amount of stalled air (boundary layer) in the corners which trigger early separation in the downstream diverging section (corner stall). An advantage of the proposed diffuser resides in the fact that right-angular corners are avoided throughout the diffuser (including the diffuser throat) and these corners contribute to the high efficiency of this diffuser, at low as well as high Mach Number operation.

Figure 6:
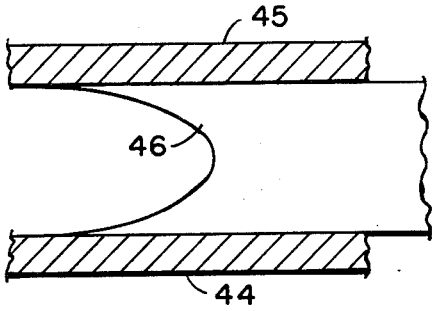
FIG. 6 is a sectional view of the leading edge of a vane member as seen from the side.

It will be noted that the intersection of two converging concave surfaces, such as pertains on the opposite sides of vanes 46, 49, 12, 15, et al. will result in the elliptical configuration shown in FIG. 6.

The taper chosen for the wedge-shaped inner portion of each vane is an important factor (see FIG. 2, line 3—3 to point 19). The general criteria is that passageway 18 have constant cross-sectional dimensions over a length defined as being between adjacent wedge-shaped inner portions of the vane. Thus, the side walls of the passageway remain parallel to each other over the length of overlap of adjacent inner end vane members. The length of the inner wedge will vary some in practice. However, the length of the passage having constant cross-sectional size will always be as long as required to establish stable flow conditions. In some implementations the length will equal or slightly exceed the width. Keeping the passageway of constant cross-section at its inner end is achieved in three ways. First, the pivot point 48 is placed at any structurally convenient location along the inner wedge-shaped section of vane 46. Second, motion of adjacent vanes along the outer periphery (for example, around pivots 47, 50, 13 and 16) is kept to small values. Third, the amount of vane taper at the inlet of the diffuser is made a function of the number of vanes used. For the case where 24 vanes are used and the ratio of the outside diameter of the diffuser to that of the impeller is as 3 to 2, a wedge of approximately 15 degrees is needed. For more vanes the wedge shape is thinner and for fewer vanes a thicker wedge is used.

As for overall length of each vane, it is of approximately the same magnitude as the radius of the impeller, for the case where the diffuser diameter is 1.5 times that of the impeller. For larger ratios of diameters, such as 5 for the diffuser and 3 for the impeller, the vane length becomes greater than the radius of the impeller.

Figure 3:
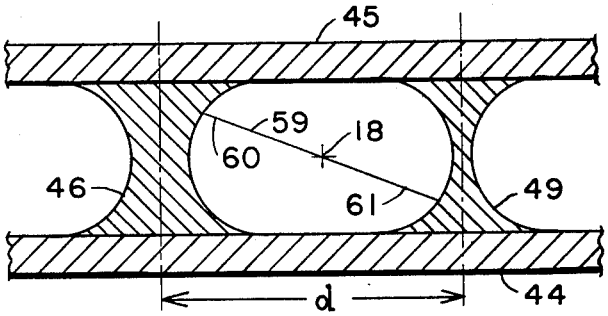
FIG. 3 is a cross section of adjacent vane members as viewed along line 3—3 of FIG. 2.

Referring now to FIG. 2, note what happens when slotted ring 25 is turned counterclockwise with respect to diffuser end plate member 44. Vanes 46, 49, 12 and 15 pivot slightly about respective pivot points 48, 11, 14 and 17. The inner pivot points 48, 11, 14, 17 et al are located in a plurality of holes spaced equidistance one-to-the-next in end plate 44 along a circle of radius 24 which is concentric with the impeller periphery 20. Counterclockwise rotation of ring 25 serves to increase the size of the passageway between adjacent vanes. Specifically, distance *d* as shown in FIG. 3 increases for a counterclockwise rotation of ring 25 with respect to end plate 44. Clockwise rotation of ring 25 narrows the passageway between vanes.

For a particular setting of the outer ring, the vanes will form passages for the fluid which are equivalent to those formed when holes of constant cross-section are cut through a solid cylindrical block of metal. By making the cross-sectional dimensions of the passages variable, a wide range of fluid operating conditions can be accommodated.

Figure 5:
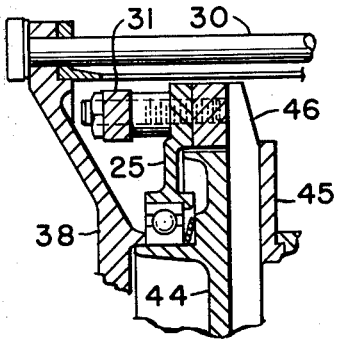
FIG. 5 is a cross-section view along line 5—5 of FIG. 4.
Figure 4:
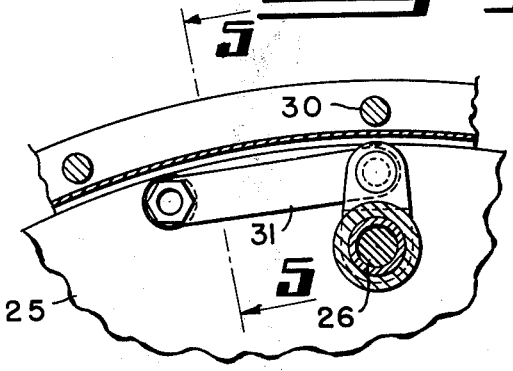
FIG. 4 is an end view of the lever arm mechanism which controls the positioning of the vanes as viewed along line 4—4 of FIG. 1.

FIGS. 4 and 5 show the attachment of the control arm to slotted ring 25. Rotation of control shaft 26 in sleeve bearing 40 of frame member 38 serves to position slotted ring 25 via connecting rod 31.

Control shaft 26 can be coupled to the fuel control system of the engine. Positioning of the vanes can be coordinated with the speed and load conditions present during operation of the system.

Fabrication of the movable vanes can be accomplished by any of several methods. Casting is one method. Forming from powdered metal alloys is another. While FIG. 1 shows vane 6 as having a constant height, use of casting techniques readily allows a choice of other shapes. For example, if overall dimensions of the diffuser are restricted, it is feasible to broaden the vane at its outer end so that the high pressure portion of the diffusion chamber is made to have annular exit ports which are coaxial with the driving shaft of the compressor.

To summarize, there is provided a plurality of movable vanes having a configuration and arrangement such that adjacent vane members form uniform passageways for a considerable distance beginning at their innermost ends. This is shown most clearly in FIG. 3 where adjacent vane members 46 and 49 have therebetween straight centerline 18. A chord 59 drawn perpendicular to and through centerline 18 will impact the walls of vanes 46 and 49 at points 60 and 61, respectively. Since the taper of each vane is chosen so that there is a passage of uniform cross-section between adjacent vane members, chord 59 drawn through centerline 18 will impact the wall of vane members 46 and 49 at points 60 and 61, with the chord being at right angles with respect to the longitudinal surface of the two passageway walls. This is true for any chord drawn through and perpendicular to centerline 18.

It is to be understood that the invention is not limited to the particular embodiment herein disclosed. Those skilled in the art will discern other ways which do not depart from the purview of the invention.

I claim:

1. An annular diffuser for use with a centrifugal compressor having a radial flow impeller whose outer periphery is closely surrounded by the inner circumference of the annular diffuser, said diffuser comprising:

a forward annular end plate;

a rear annular end plate axially spaced from said forward annular end plate;

a plurality of pivotable vanes positioned between said end plates, said vanes and said end plates defining a plurality of channels, the centerlines of said channels being tangent to a circle having approximately the same diameter as said impeller, the innermost end of each of said vanes comprising a wedge having a taper chosen such that adjacent vane members, when abutted by said forward and rear end plates, form a channel therebetween having constant cross-sectional dimensions over a length defined as being between adjacent wedge-shaped inner portions of said vanes, the wedge-shaped innermost end of each of said vanes being followed by an oppositely tapered outer end whereby a multiplicity of said vanes when assembled in substantially radial formation between said end plates form an expanding volume diffuser; and pivoting means for simultaneously pivoting each of said vanes to vary the cross-sectional area of said channels.

2. The invention as defined in claim 1 wherein said vanes are formed from powdered metal alloys.

* * * * *